US005995007A

United States Patent [19]

Borja et al.

[11] Patent Number: 5,995,007

[45] Date of Patent: Nov. 30, 1999

[54] PROXIMITY MONITORING SYSTEM

[76] Inventors: Noel J. Borja; Miriam Valdez, both of 6808 Wake Forest La., Austin, Tex. 78723

[21] Appl. No.: 09/199,103

[22] Filed: Nov. 25, 1998

[51] Int. Cl.[6] ..... G08B 23/00

[52] U.S. Cl. ..... 340/573.4; 340/573.1; 340/539; 340/691.1; 340/693.5

[58] Field of Search ..... 340/573.1, 539, 340/691.1, 693, 5, 574, 573.4; 342/457

[56] References Cited

U.S. PATENT DOCUMENTS

| | | | |
|---|---|---|---|
| 4,591,836 | 5/1986 | Feigenblatt, Jr. et al. | 340/574 |
| 4,593,273 | 6/1986 | Narcisse | 340/539 |
| 4,598,272 | 7/1986 | Cox | 340/539 |
| 4,675,656 | 6/1987 | Narcisse | 340/539 |
| 4,777,478 | 10/1988 | Hirsch et al. | 340/573.1 |
| 4,843,371 | 6/1989 | Kuel et al. | 340/539 |
| 5,014,040 | 5/1991 | Weaver et al. | 340/573.1 |
| 5,021,794 | 6/1991 | Lawrence | 342/457 |
| 5,115,223 | 5/1992 | Moody | 340/573.1 |
| 5,218,344 | 6/1993 | Ricketts | 340/573.1 |
| 5,289,163 | 2/1994 | Perez et al. | 340/539 |
| 5,298,883 | 3/1994 | Pilney et al. | 340/573.1 |
| 5,402,104 | 3/1995 | LaRosa | 340/539 |
| 5,448,221 | 9/1995 | Weller | 340/539 |
| 5,461,365 | 10/1995 | Schlager et al. | 340/573.1 |
| 5,497,149 | 3/1996 | Fast | 340/988 |
| 5,557,259 | 9/1996 | Musa | 340/573.1 |
| 5,617,074 | 4/1997 | White | 340/573.1 |
| 5,646,593 | 7/1997 | Hughes et al. | 340/573.1 |
| 5,652,569 | 7/1997 | Gerstenberger et al. | 340/573.1 |
| 5,652,570 | 7/1997 | Lepkofker | 340/573.1 |
| 5,689,240 | 11/1997 | Traxler | 340/573.1 |
| 5,900,817 | 5/1999 | Olmassakian | 340/573.1 |

*Primary Examiner*—Benjamin C. Lee

[57] ABSTRACT

A monitoring system is provided including a portable module including a radio device. Also provided is a monitoring unit also including a radio device and an indicator for providing an indication upon the radio devices being separated a predetermined amount.

7 Claims, 2 Drawing Sheets

PROXIMITY MONITORING SYSTEM

BACKGROUND OF THE INVENTION

1. Field of the Invention

The present invention relates to child monitoring devices and more particularly pertains to a new proximity monitoring system for monitoring the proximity of a child or article of value.

2. Description of the Prior Art

The use of child monitoring devices is known in the prior art. More specifically, child monitoring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,389,915; U.S. Pat. No. 5,402,104; U.S. Pat. No. 5,357,254; U.S. Pat. No. 4,394,644; U.S. Pat. No. Des. 361,942; and U.S. Pat. No. 4,408,220 which are each incorporated herein by reference.

In these respects, the proximity monitoring system according to the present invention substantially departs from the conventional concepts and designs of the prior art, and in so doing provides an apparatus primarily developed for the purpose of monitoring the proximity of a child or article of value.

SUMMARY OF THE INVENTION

In view of the foregoing disadvantages inherent in the known types of child monitoring devices now present in the prior art, the present invention provides a new proximity monitoring system construction wherein the same can be utilized for monitoring the proximity of a child or article of value.

The general purpose of the present invention, which will be described subsequently in greater detail, is to provide a new proximity monitoring system apparatus and method which has many of the advantages of the child monitoring devices mentioned heretofore and many novel features that result in a new proximity monitoring system which is not anticipated, rendered obvious, suggested, or even implied by any of the prior art child monitoring devices, either alone or in any combination thereof.

To attain this, the present invention generally comprises a wristband mount comprising of a sheet of flexible inelastic material with a uniform thickness. As shown in FIG. 2, the wristband mount has a top face, a bottom face and a periphery formed therebetween defined by a pair of elongated generally rectangular side extents and a generally circular central extent. The top face of the wristband mount has pile fasteners lining a first one of the side extents and the central extent. The bottom face has a pile fastener lining a second one of the side extents. In use, the wristband mount is adapted for being removably attached to a wrist of a small child. Associated therewith is an adhesive mount having a rigid planar generally circular configuration. The adhesive mount is equipped with a top face having a pile fastener mounted thereon and a bottom face having an adhesive formed thereon for being secured to a piece of luggage. FIGS. 3 & 4 depict a portable module having a disk-shaped configuration defined by a top face, a bottom face and a periphery formed therebetween. Ideally, the portable module is equipped with a size similar to that of the adhesive mount and the central extent of the wristband mount. The bottom face has a pile fastener mounted thereon as shown in FIG. 5 for releasably securing to at least one of the mounts. The portable module includes a green light emitting diode and a red light emitting diode each mounted to the top face of the portable module. In use, the diodes are adapted for illuminating upon the actuation thereof. The portable module further includes a speaker for emitting an audible alarm upon the actuation thereof. The portable module further has a transceiver which is adapted to operate in a first mode upon the receipt of an activation signal. In such mode, the transceiver is adapted to continuously and unconditionally actuate the green light emitting diode. Further, the speaker is actuated and an out-of-range signal transmitted via free space during the lack of the receipt of a monitoring signal. In a second mode, the transceiver further serves to only actuate the red light emitting diode. It should be noted that the transceiver operates in the second mode only upon the receipt of a deactivation signal. As shown in FIG. 1, a wrist-mounted monitoring unit is provided including a disk-shaped central portion with a top face, a bottom face, and a periphery formed therebetween. The monitoring unit includes a pair of generally rectangular flexible bands each having an inboard end hingably coupled to diametrically opposed sides of the periphery of the central portion. Outboard ends of the bands are equipped with a buckle for coupling to a wrist of a user. As shown in FIG. 1, the central portion has a green light emitting diode and a red light emitting diode each mounted to the top face for illuminating upon the actuation thereof. A transceiver is connected to a push button on the periphery of the central portion. Upon the first depression of the push button, the green light emitting diode of the monitoring unit is unconditionally and continuously actuated thereby indicating operation in a first mode. In such mode, the activation signal is instantaneously transmitted from the transceiver of the monitoring unit immediately after the push button is depressed, thereby actuating the portable module in the first mode thereof. During operation in the first mode, the transceiver of the monitoring unit continuously transmits the monitoring signal from the transceiver of the monitoring unit with an intensity for effecting transmission within a predetermined range. Upon the receipt of the out-of-range signal, the transceiver actuates the speaker of the monitoring unit thus giving an indication that the portable module is out of the predetermined range. The push button is further adapted to only illuminate the red light emitting diode of the monitoring unit upon the subsequent depression thereof, thereby indicating operation in a deactivated second mode of operation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new proximity monitoring system apparatus and method which has many of the advantages of the child monitoring devices mentioned heretofore and many novel features that result in a new proximity monitoring system which is not anticipated, rendered obvious, suggested, or even implied by any of the prior art child monitoring devices, either alone or in any combination thereof.

It is another object of the present invention to provide a new proximity monitoring system which may be easily and efficiently manufactured and marketed.

It is a further object of the present invention to provide a new proximity monitoring system which is of a durable and reliable construction.

An even further object of the present invention is to provide a new proximity monitoring system which is susceptible of a low cost of manufacture with regard to both materials and labor, and which accordingly is then susceptible of low prices of sale to the consuming public, thereby making such proximity monitoring system economically available to the buying public.

Still yet another object of the present invention is to provide a new proximity monitoring system which provides in the apparatuses and methods of the prior art some of the advantages thereof, while simultaneously overcoming some of the disadvantages normally associated therewith.

Still yet another object of the present invention is to provide a new proximity monitoring system for monitoring the proximity of a child or article of value.

Even still another object of the present invention is to provide a new proximity monitoring system that includes a portable module including a radio device. Also provided is a monitoring unit also including a radio device and an indicator for providing an indication upon the radio devices being separated a predetermined amount.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
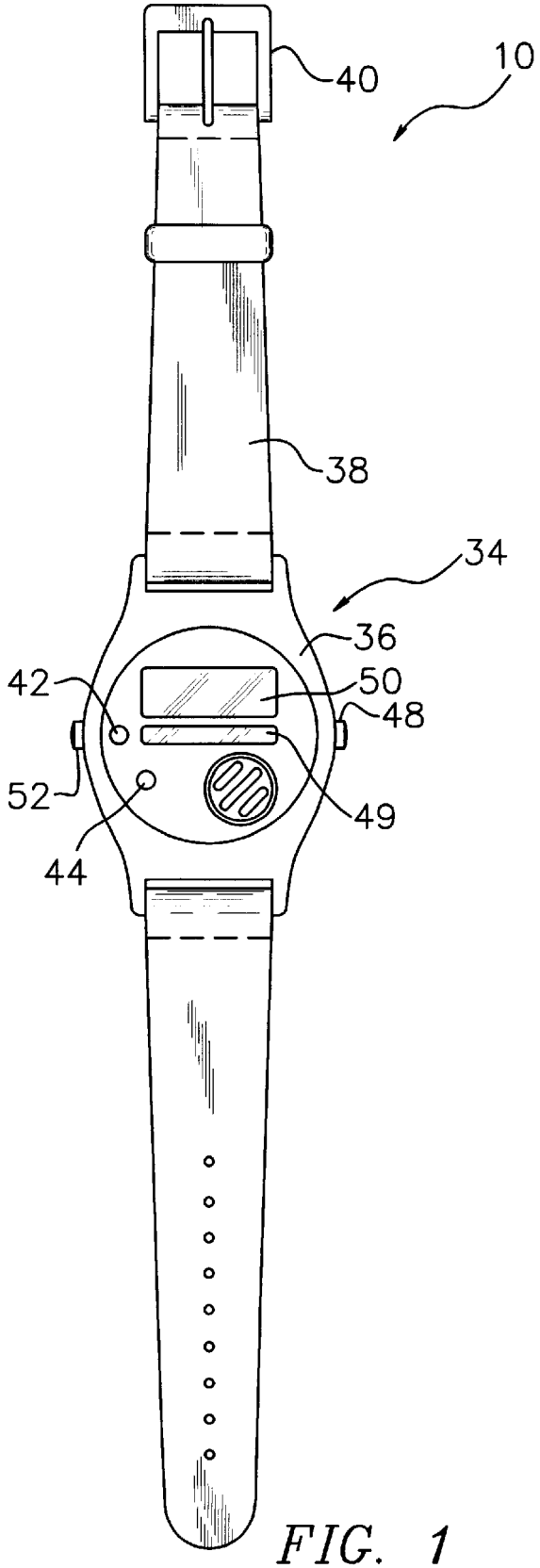
FIG. 1 is a front view of a new proximity monitoring system according to the present invention.

With reference now to the drawings, and in particular to FIGS. 1 through 5 thereof, a new proximity monitoring system embodying the principles and concepts of the present invention and generally designated by the reference numeral 10 will be described.

Figure 2:
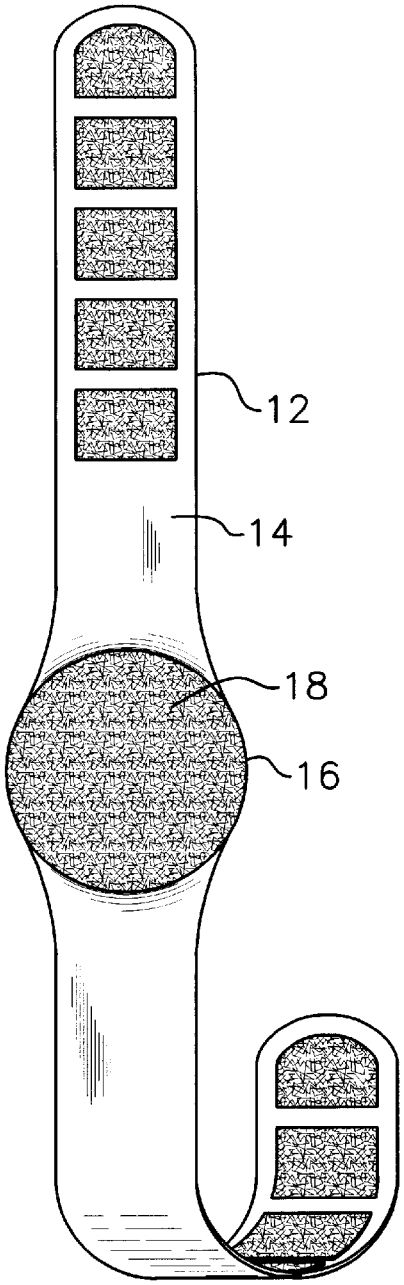
FIG. 2 is a front view of the wristband mount of the present invention.

The present invention, designated as numeral 10, includes a wristband mount 12 comprising of a sheet of flexible inelastic material with a uniform thickness. As shown in FIG. 2, the wristband mount has a top face, a bottom face and a periphery formed therebetween defined by a pair of elongated generally rectangular side extents 14 and a generally circular central extent 16. The top face of the wristband mount has pile fasteners 18 lining a first one of the side extents and the central extent. The bottom face has a pile fastener lining a second one of the side extents. In use, the wristband mount is adapted for being removably attached to a wrist of a small child. Ideally, the pile fasteners of the side extents are formed in rectangular blocks and are spaced with respect to each other and the periphery of the wristband mount.

Associated therewith is an adhesive mount 18 having a rigid planar generally circular configuration. The adhesive mount is equipped with a top face having a pile fastener 20 mounted thereon and a bottom face having an adhesive 22 formed thereon for being secured to a piece of luggage, a laptop, a purse, or any other item of value.

Figure 3:
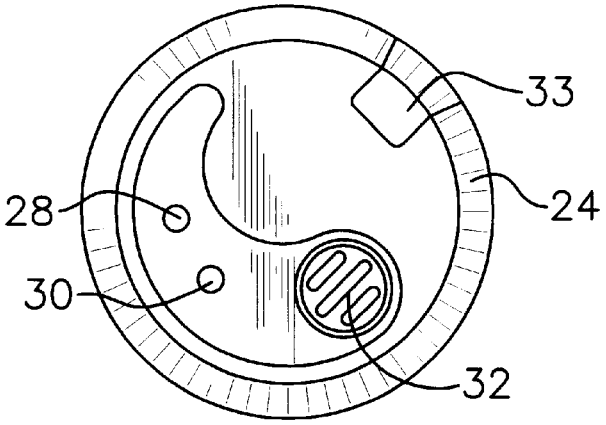
FIG. 3 is a top view of the portable module of the present invention.
Figure 4:
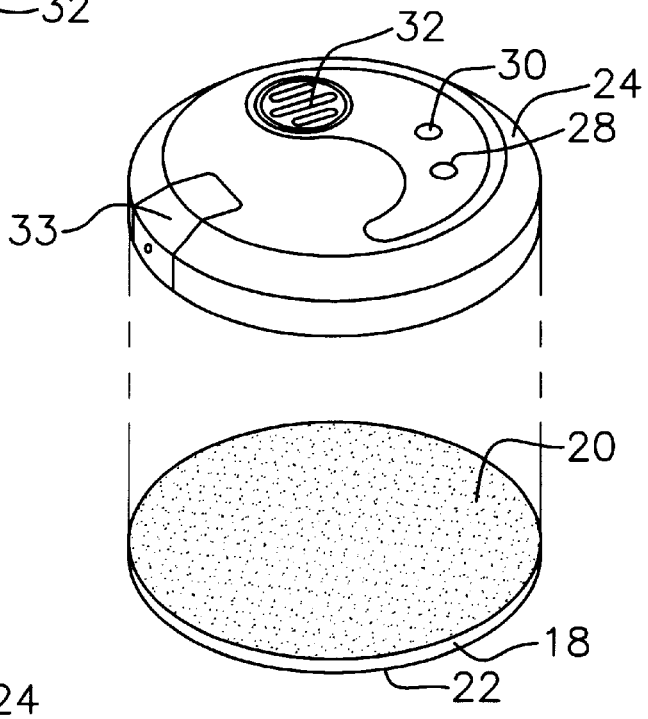
FIG. 4 is an exploded view of the portable module and the adhesive mount of the present invention.
Figure 5:
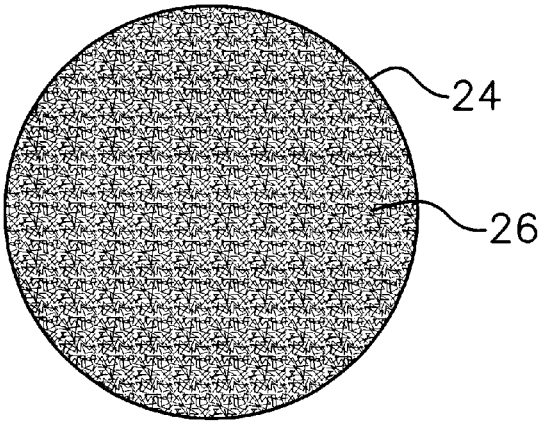
FIG. 5 is a bottom view of the portable module of the present invention.

FIGS. 3 & 4 depict a portable module 24 having a disk-shaped configuration defined by a top face, a bottom face and a periphery formed therebetween. Ideally, the portable module is equipped with a size similar to that of the adhesive mount and the central extent of the wristband mount. The bottom face of the portable module has a pile fastener 26 mounted thereon as shown in FIG. 5 for releasably securing to at least one of the mounts.

The portable module includes a green light emitting diode 28 and a red light emitting diode 30 each mounted to the top face of the portable module. In use, the foregoing diodes are adapted for illuminating upon the actuation thereof. The portable module further includes a speaker 32 for emitting an audible alarm upon the actuation thereof. The portable module further has an unillustrated transceiver which is connected to each of the components of the portable module and adapted to operate in a first mode upon the receipt of an activation signal. In such mode, the transceiver is adapted to continuously and unconditionally actuate the green light emitting diode to indicate the current mode of operation. Further, the speaker is actuated and an out-of-range signal transmitted via free space during the lack of receipt of a monitoring signal. In a second mode, the transceiver further serves to only actuate the red light emitting diode. It should be noted that the transceiver operates in the second mode only upon the receipt of a deactivation signal. A portion 33 of the top face and the periphery is preferably removably secured over a compartment via a screw formed in the portable module for housing a battery therein.

As shown in FIG. 1, a wrist-mounted monitoring unit 34 is provided including a disk-shaped central portion 36 with a top face, a bottom face, and a periphery formed therebetween. The monitoring unit includes a pair of generally rectangular flexible bands 38 each having an inboard end hingably coupled to diametrically opposed sides of the periphery of the central portion. Outboard ends of the bands are equipped with a buckle 40 for coupling to a wrist of a user.

As shown in FIG. 1, the central portion has a green light emitting diode 42 and a red light emitting diode 44 each mounted to the top face for illuminating upon the actuation thereof. A transceiver (not shown) is connected to each of the components of the monitoring unit including a push button 48 on the periphery of the central portion. Upon the first depression of the push button, the green light emitting diode of the monitoring unit is unconditionally and continuously actuated thereby indicating operation in a first mode. In such mode, the activation signal is instantaneously transmitted from the transceiver of the monitoring unit immediately after the push button is depressed, thereby actuating the portable module in the first mode thereof. During operation in the first mode, the transceiver of the monitoring unit continuously transmits the monitoring signal from the transceiver of the monitoring unit with an intensity for effecting transmission within a predetermined range. Upon the receipt of the out-of-range signal, the transceiver actuates a speaker of the monitoring unit thus giving an indication that the portable module is out of the predetermined range. As an option, the light emitting diodes may be intermittently illuminated with the actuation of the speaker. It should be noted that the out-of-range signal is of higher intensity with respect to the monitoring signal.

The push button is further adapted to only illuminate the red light emitting diode of the monitoring unit upon the subsequent depression thereof, thereby indicating operation in a deactivated second mode of operation. Ideally, operation of the monitoring unit may be toggled between the first and second mode by subsequent depression of the push button. The top face of the monitoring unit preferably also includes an auxiliary display 49 for depicting the word "ACTIVATED" while the green light is actuated and the word "DEACTIVATED" while the red light is actuated.

In the preferred embodiment, the monitoring unit is further equipped with a clock display 50 for indicating a current time. Further, another push button 52 is preferably positioned diametrically opposed the aforementioned push button for controlling the operation of the clock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A monitoring system comprising, in combination:

a wristband mount comprising of a sheet of flexible inelastic material with a uniform thickness, the wristband mount having a top face, a bottom face and a periphery formed therebetween defined by a pair of elongated generally rectangular side extents and a generally circular central extent, the top face of the wristband mount having pile fasteners lining a first one of the side extents and the central extent, the bottom face having a pile fastener lining a second one of the side extents, wherein the wristband mount is adapted for being removably attached to a wrist of a small child;

an adhesive mount having a rigid planar generally circular configuration with a top face having a pile fastener mounted thereon and a bottom face having an adhesive formed thereon for being secured to a piece of luggage;

a portable module having a disk-shaped configuration defined by a top face, a bottom face and a periphery formed therebetween with a size similar to that of the adhesive mount and the central extent of the wristband mount, the bottom face having a pile fastener mounted thereon for releasably securing to at least one of the mounts, the portable module including a green light emitting diode and a red light emitting diode each mounted to the top face of the portable module and adapted for illuminating upon the actuation thereof, the portable module further including a speaker for emitting an audible alarm upon the actuation thereof, the portable module further including a transceiver which is adapted to operate in a first mode upon the receipt of an activation signal during which the transceiver is adapted to continuously and unconditionally actuate the green light emitting diode and actuate the speaker and transmit an out-of-range signal during the lack of the receipt of a monitoring signal, the transceiver further adapted to only actuate the red light emitting diode upon the receipt of a deactivation signal; and a wrist-mounted monitoring unit including a disk-shaped central portion with a top face, a bottom face, and a periphery formed therebetween, the monitoring unit including a pair of generally rectangular flexible bands each having an inboard end hingably coupled to diametrically opposed sides of the periphery of the central portion and outboard ends with a buckle for coupling to a wrist of a user, the central portion having a green light emitting diode and a red light emitting diode each mounted to the top face for illuminating upon the actuation thereof, a transceiver connected to a push button on the periphery of the central portion for unconditionally and continuously actuating the green light emitting diode of the monitoring unit, instantaneously transmitting the activation signal from the transceiver of the monitoring unit, continuously transmitting the monitoring signal from the transceiver of the monitoring unit with an intensity for effecting transmission within a predetermined range, and actuate the speaker of the monitoring unit upon the receipt of the out-of-range signal thus giving an indication that the portable module is out of the predetermined range, the push button further adapted to only illuminate the red light emitting diode of the monitoring unit upon the subsequent depression thereof.

2. A monitoring system comprising:

a portable module including a radio device; and a monitoring unit including a radio device and an indicator for providing an indication upon the radio devices being separated by a predetermined amount;

wherein the radio device of the portable module is selectively deactivated by the monitoring unit;

wherein the portable module has a light indicating whether the radio device thereof is deactivated;

wherein the monitoring unit has a light indicating whether the radio device of the portable module is deactivated.

3. A monitoring system as set forth in claim 2 wherein the monitoring unit is wrist-mounted and has a clock mounted thereon.

4. A monitoring system as set forth in claim 2 wherein the portable module is removably attached to a mount which is adhesively secured to a recipient surface.

5. A monitoring system as set forth in claim 2 wherein the portable module is removably attached to a wrist strap.

6. A monitoring system as set forth in claim 2 wherein the indicator includes a speaker for generating an audible alarm.

7. A monitoring system as set forth in claim 2 wherein the portable module includes a speaker for generating an audible alarm upon the radio devices being separated the predetermined amount.

* * * * *